US009994066B2

(12) United States Patent
Hayao et al.

(10) Patent No.: US 9,994,066 B2
(45) Date of Patent: Jun. 12, 2018

(54) ERASING IMPLEMENT AND WRITING IMPLEMENT PROVIDED WITH ERASING IMPLEMENT

(71) Applicant: MITSUBISHI PENCIL COMPANY, LIMITED, Tokyo (JP)

(72) Inventors: Sakae Hayao, Tokyo (JP); Hiroshi Ohtsuka, Kanagawa (JP); Tsuyoshi Nishida, Tokyo (JP)

(73) Assignee: Mitsubishi Pencil Company, Limited, Tokyo (JP)

( * ) Notice: Subject to any disclaimer, the term of this patent is extended or adjusted under 35 U.S.C. 154(b) by 903 days.

(21) Appl. No.: 14/374,102

(22) PCT Filed: Jan. 24, 2013

(86) PCT No.: PCT/JP2013/051499
§ 371 (c)(1),
(2) Date: Jul. 23, 2014

(87) PCT Pub. No.: WO2013/111832
PCT Pub. Date: Aug. 1, 2013

(65) Prior Publication Data

US 2015/0033499 A1 Feb. 5, 2015

(30) Foreign Application Priority Data

Jan. 24, 2012 (JP) ..... 2012-012236
Feb. 24, 2012 (JP) ..... 2012-038108

(51) Int. Cl.
*B43L 19/00* (2006.01)
*B43K 29/02* (2006.01)
(Continued)

(52) U.S. Cl.
CPC ..... *B43L 19/0025* (2013.01); *B43K 23/02* (2013.01); *B43K 24/146* (2013.01);
(Continued)

(58) Field of Classification Search
CPC ... B43L 19/00; B43L 19/0056; B43L 19/0068
See application file for complete search history.

(56) References Cited

U.S. PATENT DOCUMENTS 2,115,806 A * 5/1938 Frederick ..... B43L 19/0068 15/433
2,520,085 A * 8/1950 Howard ..... B43L 19/00 15/426
5,897,265 A 4/1999 Wilson

FOREIGN PATENT DOCUMENTS

CH 311830 A 12/1955
DE 269229 C 1/1914
(Continued)

OTHER PUBLICATIONS

Microfilm of the specification and drawing annexed to the request of Japanese Utility Model Application No. 79381/1981 (Laid-open No. 191598/1982) (Hakko Enpitsu Kabushiki Kaisha), Dec. 4, 1982.

*Primary Examiner* — Randall Chin
(74) *Attorney, Agent, or Firm* — Foley & Lardner LLP

(57) ABSTRACT

Provided are an erasing implement and a writing implement equipped with the erasing implement, the erasing implement being capable of erasing writing regardless of the type of ink or lead of the writing implement, even writing with thermochromic ink or writing with pencil lead. The erasing implement is equipped with a first erasing member for erasing writing with thermochromic ink and a second erasing member for erasing writing of types other than thermochromic ink, and is configured by covering the outer surface of the second erasing member with the first erasing member.

2 Claims, 15 Drawing Sheets

(51) Int. Cl.

| | |
|---|---|
| ***B43K 24/14*** | (2006.01) |
| ***B43K 24/16*** | (2006.01) |
| ***B43K 25/02*** | (2006.01) |
| ***B43K 27/02*** | (2006.01) |
| ***B43K 23/02*** | (2006.01) |

(52) U.S. Cl.

CPC ..... *B43K 24/166* (2013.01); *B43K 25/028* (2013.01); *B43K 27/02* (2013.01); *B43K 29/02* (2013.01); *B43L 19/00* (2013.01); *B43L 19/005* (2013.01); *B43L 19/0056* (2013.01); *B43L 19/0068* (2013.01); *B43L 19/0081* (2013.01)

(56) References Cited

FOREIGN PATENT DOCUMENTS

| | | | |
|---|---|---|---|
| GB | 17944 | | 7/1910 |
| JP | 10-003722 | Y | 4/1935 |
| JP | 10-003722 | Y1 | 4/1935 |
| JP | 53-044048 | U | 4/1978 |
| JP | 02-108091 | U | 8/1990 |
| JP | 2002-225493 | A | 8/2002 |
| JP | 2005-313404 | A | 11/2005 |
| JP | 2005-335211 | A | 12/2005 |
| JP | 2008-302673 | A | 12/2008 |
| JP | 2009-107236 | A | 5/2009 |
| JP | 2009-107240 | A | 5/2009 |
| JP | 2011-224860 | A | 11/2011 |

* cited by examiner (a)

(b)

(c)

ERASING IMPLEMENT AND WRITING IMPLEMENT PROVIDED WITH ERASING IMPLEMENT

TECHNICAL FIELD

The present invention relates to an eraser which can erase marks made by a ball pen, marking pen, fountain pen, pencil, color pencil, thermochromic ink, etc. and to a writing instrument which is provided with such an eraser.

BACKGROUND ART

In the past, many erasers which can erase marks by commercially available eraser materials have been disclosed. However, when using the commercially available eraser materials as erasers for erasing marks by heat of friction, the marks cannot be efficiently erased. Therefore, PLT 1 discloses use of a rubbing member made of a synthetic resin which has elasticity as an erasing part. However, with the rubbing member of PLT 1, while thermochromic ink marks can be erased easily, it is difficult to erase marks made by conventional pencil lead or erasable ink etc.

CITATIONS LIST

Patent Literature

PLT 1: Japanese Patent Publication No. 2009-107240A

SUMMARY OF INVENTION

Technical Problem

Therefore, the object is the provision of an eraser which is able to erase marks regardless of the type of ink or lead of the writing instrument—either thermochromic ink marks or pencil lead marks—and a writing instrument which is provided with such an eraser.

Solution to Problem

According to one aspect of the present invention, there is provided an eraser characterized by being provided with a first erasing member for erasing marks made by thermochromic ink and a second erasing member for erasing marks of a type different from thermochromic ink, wherein the first erasing member covers the outer surface of the second erasing member. Note that the "erasing marks" mentioned here includes the vanishing of color and the change of color in thermochromic ink.

Further, according to another aspect of the present invention, there is provided a writing instrument which is provided with an eraser according to the above-mentioned aspect of the present invention.

Advantageous Effects of Invention

According to the present invention, it is possible to provide an eraser which is able to erase marks regardless of the type of ink or lead of the writing instrument—either thermochromic ink marks or pencil lead marks—and a writing instrument which is provided with an eraser. That is, it is possible to erase marks made by various writing instruments which contain several types of ink or lead. Below, the present invention will be much more sufficiently understood from the attached drawings and the description of the preferred embodiments of the present invention.

DESCRIPTION OF EMBODIMENTS

Figure 1:
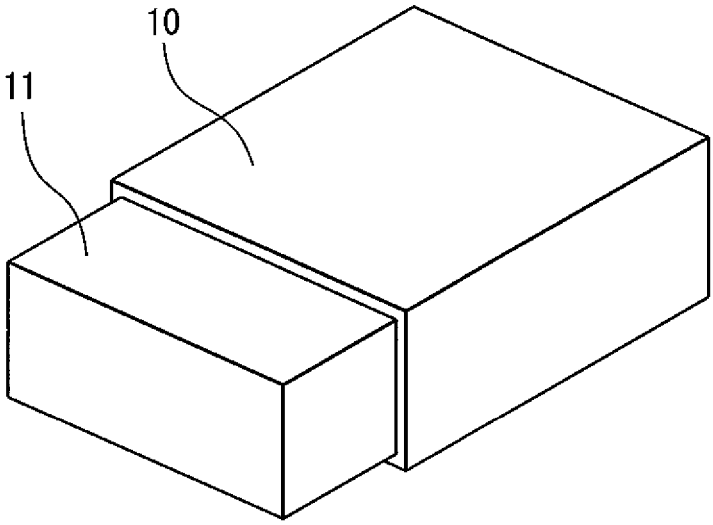
FIG. 1 is an overall view of a first example of an eraser in the present invention.

Below, the invention will be explained while referring to the drawings. FIG. 1 is an overall view of a first example of an eraser in the present invention. A first erasing member constituted by an eraser for thermochromic ink use 10 is formed as an eraser case which holds a second erasing member constituted by an eraser for pencil lead use 11. The eraser for thermochromic ink use 10 is comprised of polypropylene: 25 parts by weight and a styrene-based thermoplastic elastomer: 75 parts by weight. The eraser for pencil lead use 11 is a so-called general eraser which is mainly comprised of a vinyl chloride-vinyl acetate copolymer or other resin and a plasticizer, also has a stabilizer, filler, etc. added in accordance with need, is formed by injection molding, and satisfies the matters described in JIS 56050, 3.2. Performance.

Here, the "thermochromic ink" means ink which has the property of maintaining a predetermined color (first color) at ordinary temperature (for example 25° C.) changing to a separate color (second color) when made to rise to a predetermined temperature (for example 60° C.), then returning again to the original color (first color) when cooled down to a predetermined temperature (for example −5° C.). In thermochromic ink, making the above second color an invisible color and raising the temperature of the lines written by the first color (for example red) to make them colorless is referred to here as "erasing". Therefore, in the following embodiment, paper etc. on which lines are written is rubbed against by a rubbing member constituted by the eraser for thermochromic ink use to generate heat of friction and thereby make the written lines an invisible color, that is, erase them. Note that, only naturally, the second color may also be a visible color rather than an invisible color. Further, the thermochromic ink may also be made a non-reversible one such as described in Japanese Patent Publication No. 2010-241867A.

Further, the media which are used to makes the lines which are erased by the second erasing member in the present invention include not only pencil lead, but also lead of mechanical pencils and ink which can be erased by rubbing but not thermochromic ink. For example, "erasable ink" indicates ink in which water, nonthermoplastic colored resin particles, and the noncolored particles are at least contained.

The first erasing member constituted by the eraser for thermochromic ink use 10 serves as the holder when using the second erasing member constituted by the eraser for pencil lead use 11. Note that, here, the eraser for thermochromic ink use 10 and the eraser for pencil lead use 11 are integrally formed by two-color molding etc., but it is also possible to form them separately and make the eraser for thermochromic ink use 10 function as the eraser case for the eraser for pencil lead use 11. Note that, the eraser for thermochromic ink use 10 of the present example is a closed bottom box shape with one side open, but it may also be made a shape which covers all surfaces of the eraser for pencil lead use 11 and can be separated from them.

Figure 2:
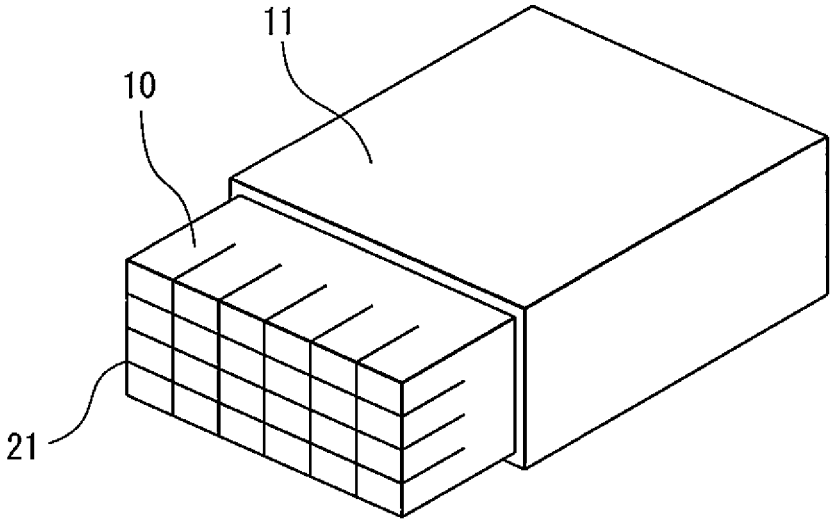
FIG. 2 is an overall view of a second example of an eraser in the present invention.

FIG. 2 is an overall view of a second example of an eraser in the present invention. The points of difference from the first example are that the outer circumference side is the second erasing member formed by the eraser for pencil lead use 11 and the inner circumference side is the first erasing member formed by the eraser for thermochromic ink use 10 and that the eraser for thermochromic ink use 10 is given a plurality of cuts 21 at its surface. The cuts 21 enable heat of friction to be easily generated at the time of erasure, so the efficiency of erasure of marks made by the thermochromic ink can be improved. Note that the numbers and directions of the cuts 21 are not particularly specified.

Figure 3:
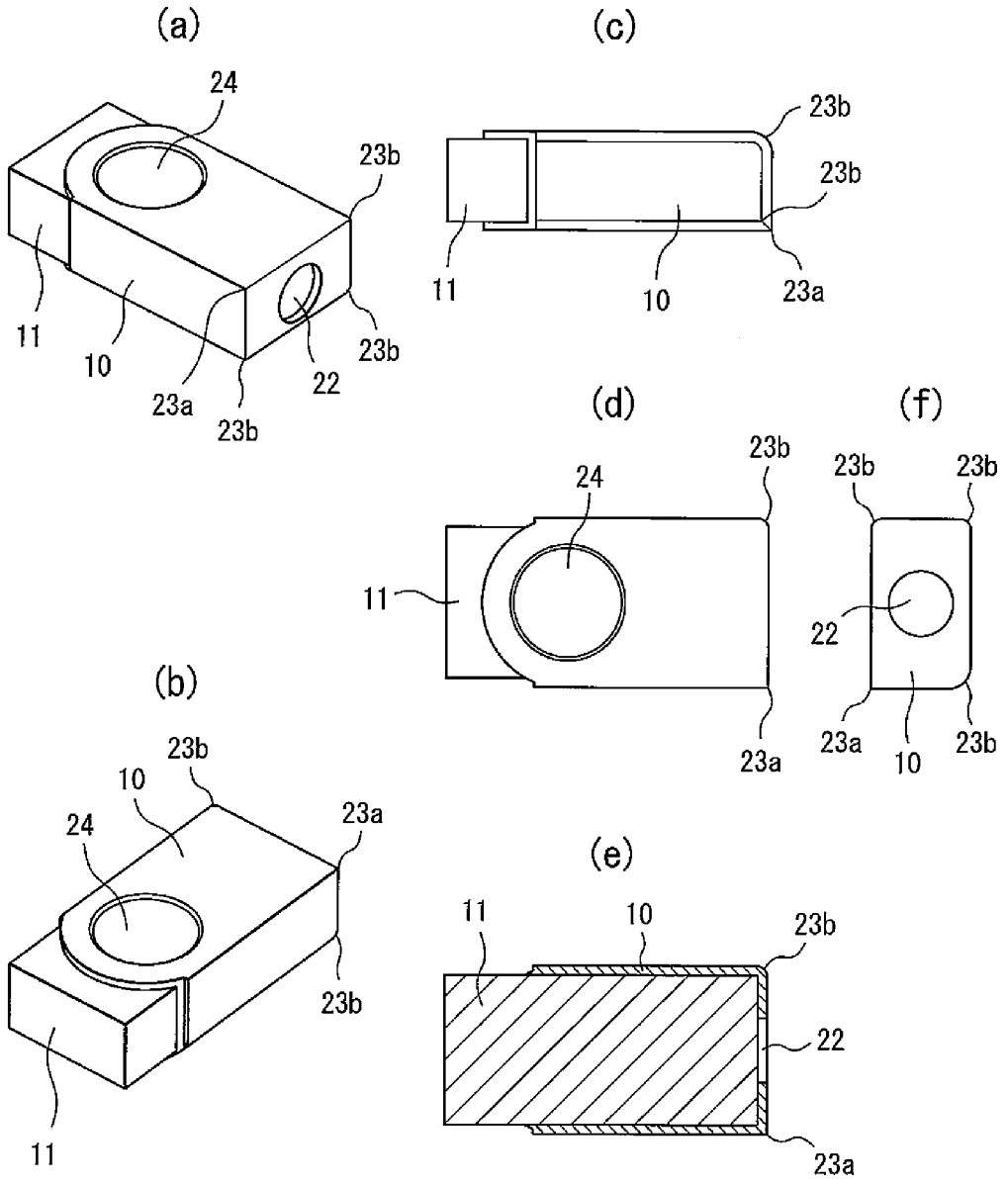
FIG. 3 is an overall view of a third example of an eraser in the present invention.

FIG. 3 is an overall view of a third example of an eraser in the present invention. FIG. 3(*a*) is a perspective view from the back of FIG. 3(*d*), FIG. 3(*b*) is a perspective view from the front of FIG. 3(*d*), FIG. 3(*c*) is a plan view, FIG. 3(*d*) is a front view, FIG. 3(*e*) is a vertical cross-sectional view, and FIG. 3(*f*) is a side view.

The first erasing member constituted by the eraser for thermochromic ink use 10 serves as the eraser case of the second erasing member constituted by the eraser for pencil lead use 11. The eraser for thermochromic ink use 10 is formed into a closed bottom box shape. At the approximate center part of the bottom surface, a through hole 22 is formed to enable the eraser for pencil lead use 11 to be easily detached by preventing a suction state and facilitating push out. Further, at the edges of the bottom surface, the corner part 23*a* and the edge parts 23*b* are formed combined. The corner part 23*a* is sharp in shape, so is suitable for erasing minute areas and erasure by a light force. The plurality of formed edge parts 23*b* are rounded surfaces with different curvatures, and therefore compared with the corner part 23*a*, a large area can be erased by a single rubbing operation. The eraser for thermochromic ink use 10 is provided symmetrically at two surfaces with recessed parts 24 which are formed as circular shaped depressions so as to thereby enable easier gripping by the hand when erasing marks. Note that the recessed parts 24 need not be circular shapes and may also be square shapes, triangular shapes, elliptical shapes, etc. The shapes are not an issue so long as they are sunk in from the surfaces of the case.

Figure 4:
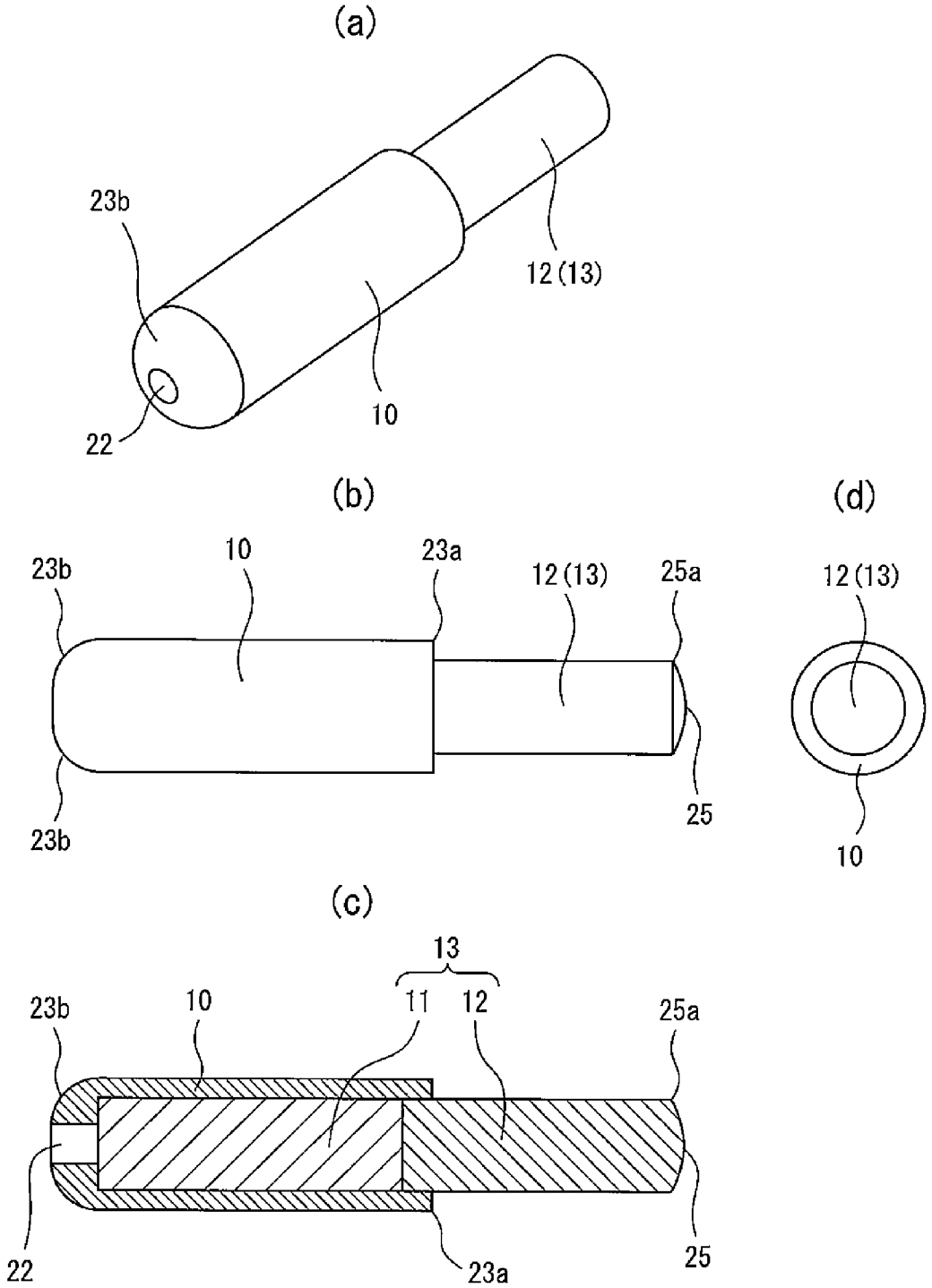
FIG. 4 is an overall view of a fourth example of an eraser in the present invention.

FIG. 4 is an overall view of a fourth example of a cylindrical shape eraser. FIG. 4(*a*) is a perspective view from the front, FIG. 4(*b*) is a front view, FIG. 4(*c*) is a vertical cross-sectional view of FIG. 4(*d*), and FIG. 4(*d*) is a side view.

The first erasing member constituted by the eraser for thermochromic ink use 10 has a cylindrical shape with one open end. From the open side, the second erasing member constituted by the eraser for pencil lead use 11 and the first erasing member also constituted by the eraser for thermochromic ink use 12 together forming the eraser 13 are inserted, so the function of a cap is given. By the eraser for thermochromic ink use 10 covering the eraser for pencil lead use 11 as a cap like in the present example, it is possible to prevent the pencil lead after use of the eraser for pencil lead use 11 from being transferred elsewhere and dirt in the air from adhering to the surfaces.

The eraser for thermochromic ink use 10 is formed with a through hole 22 at the approximate center of its front side end face so as to facilitate insertion and removal of the eraser 13. Around it, an end part 23*b* which has a curved surface is formed. The end part 23*b* has a curvature and curved surface different from the curved surface part 25 which is formed at the eraser for thermochromic ink use 12 of the eraser 13 so the user can easily select the erased area when erasing thermochromic ink.

The corner part 23*a* which is formed at the cap opening end is formed smaller in curvature than the end part 23*b*, so can easily erase a smaller area. When desiring to easily erase a further smaller area than by erasure by the corner part 23*a*, the corner part 25*a* may be used.

Figure 5:
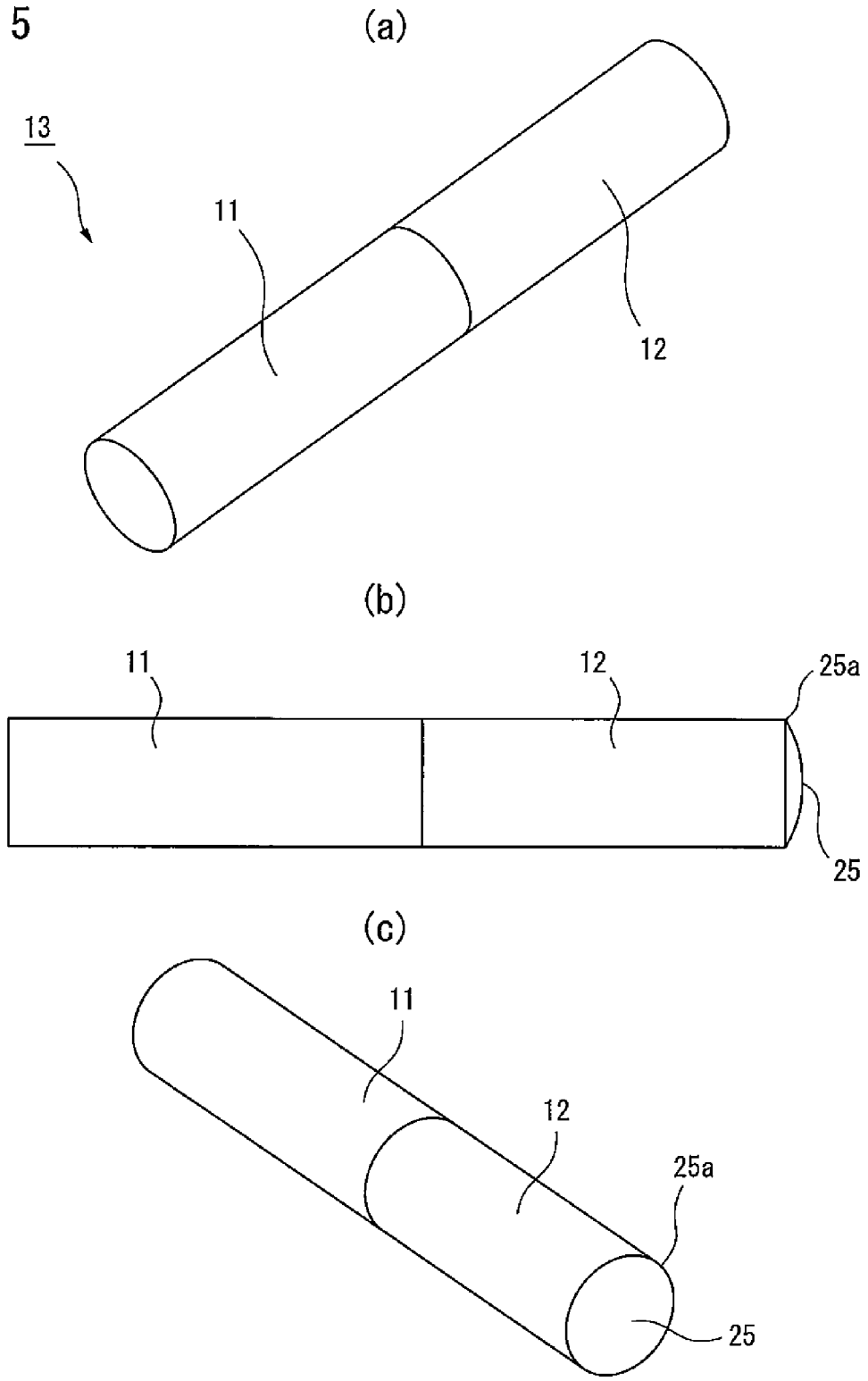
FIG. 5 is a view of the fourth example in the present invention with the cap removed.

FIG. 5 is a view of the eraser 13 with the eraser for thermochromic ink use 10 detached in the fourth example of the present invention which was explained in FIG. 4. FIG. 5(*a*) is a perspective view from the front, FIG. 5(*b*) is a front view, and FIG. 5(*c*) is a perspective view from the back.

The eraser 13 is comprised of the second erasing member constituted by the eraser for pencil lead use 11 and the first erasing member constituted by the eraser for thermochromic ink use 12 formed integrally into a cylindrical shape. Note that as the method of integrally joining them, bonding, mating, or press fitting the end faces of the erasers or forming the erasers by two-color molding etc. may be mentioned. The back side of the eraser for thermochromic ink use 12, in the figure, the right side end face, the corner part 25*a* and curved surface part 25 are formed. The corner part 25*a* is suitable for erasing minute areas so the contact area can easily be made small, while the curved surface part 25 is suitable for erasing broad areas since it can easily be made to abut against the contact surface in a planar manner. Further, when erasing by the eraser for pencil lead use 11, the eraser for thermochromic ink use 12 can be used as the holder for the eraser for pencil lead use 11 to enable lines made by pencil lead to be erased without stickiness to the hand.

Figure 6:
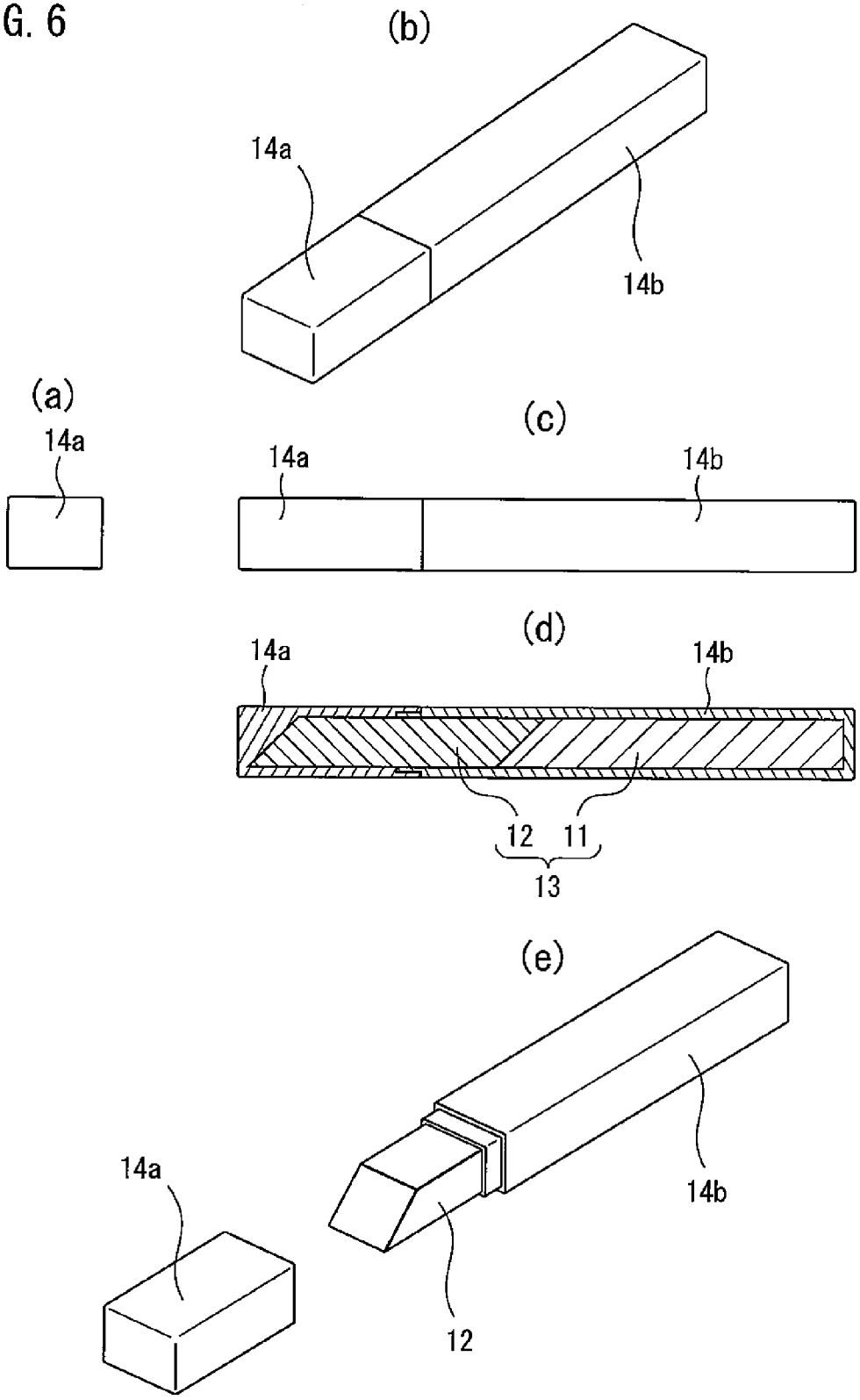
FIG. 6 is an overall view of a fifth example of an eraser in the present invention.

FIG. 6 is an overall view of a cylindrical shape eraser which is formed into a block shape in a fifth example of the present invention. FIG. 6(*a*) is a left side view, FIG. 6(*b*) is a perspective view from the front, FIG. 6(*c*) is a front view, FIG. 6(*d*) is a vertical cross-sectional view of FIG. 6(*c*), and FIG. 6(*e*) is a perspective view from the front after detaching the front part 14*a* of FIG. 6(*b*) from the back part 14*b*.

The eraser 13 is held inside of a hard case when not being used. At the time of use, the front part 14*a* and the back part 14*b* of the hard case can be separated, so the eraser 13 can be taken out and used to erase marks. The front part 14*a* and the back part 14*b* are connected, as shown in FIG. 6(*e*), by the method of mating with a groove, but the methods of press fitting by shrink fitting, engagement by undercut (relief shapes at inside surfaces), or fastening by screwing are also possible. The hard case is formed by polycarbonate or ABS, PET, PBT, or another hard plastic, but it may also be formed by PTFE, polyethylene, polypropylene, or another soft plastic or semihard plastic and used as an eraser for thermochromic ink use which can easily erase marks made by thermochromic ink.

Figure 7:
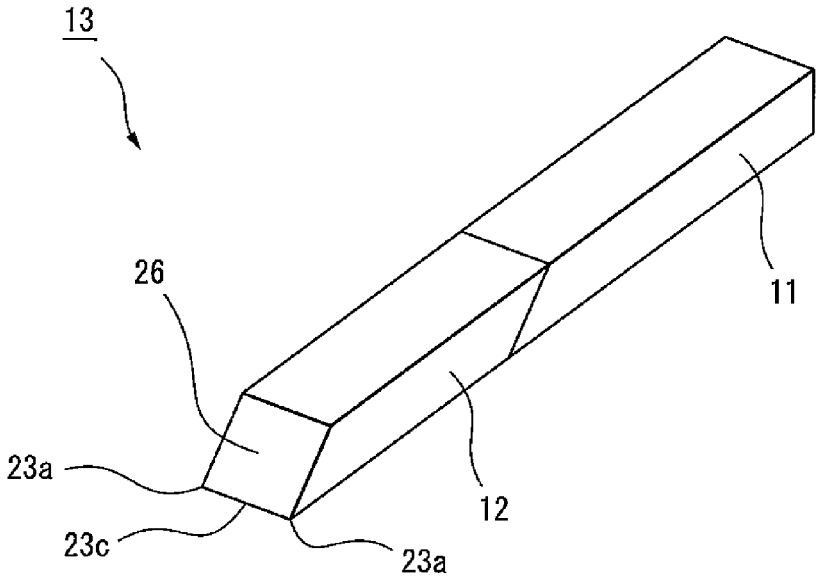
FIG. 7 is a view of the fifth example in the present invention with the hard case removed.
Figure 7:
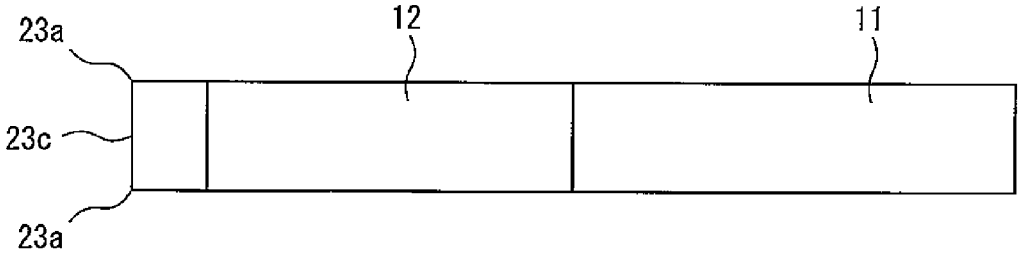
Figure 7:
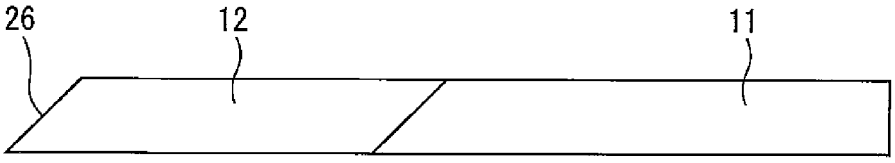

FIG. 7 is a view of an eraser 13 after removing the hard case in the fifth example of the present invention which was explained in FIG. 6. FIG. 7(*a*) is a perspective view from the front, FIG. 7(*b*) is a plan view, and FIG. 7(*c*) is a front view.

The eraser 13, like the fourth example of an eraser, is comprised of a second erasing member constituted by an eraser for pencil lead use 11 and a first erasing member constituted by an eraser for thermochromic ink use 12 which are joined integrally. The differences from the fourth example of an eraser are that the outside surface is formed into a block shape and the end face of the eraser for thermochromic ink use 12 at the front side is formed by a slanted flat part 26. At the front end part of the flat part 26, the line which connects the two corner part 23*a* forms a line part 23*c*, so the flat part 26 is superior for erasing marks over broad areas, the line part 23*c* is superior for erasing marks of elongated shapes, and the corner parts 23*a* are superior for erasing marks such as words which are written in small areas.

Figure 8:
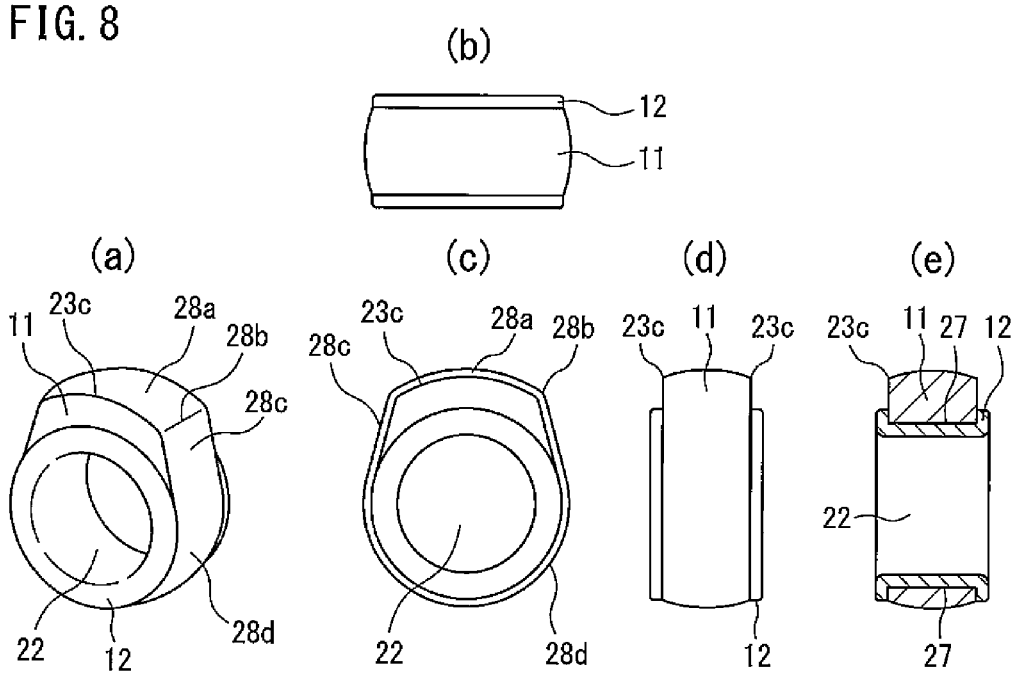
FIG. 8 is an overall view of a sixth example of an eraser in the present invention.

FIG. 8 is an overview of a sixth example of an eraser in the present invention which is comprised of a modification of the eraser 13 made of an eraser for thermochromic ink use 12 and an eraser for pencil lead use 11 which are joined together and forms a ring-shaped eraser. FIG. 8(*a*) is a perspective view from the front, FIG. 8(*b*) is a plan view, FIG. 8(*c*) is a front view, FIG. 8(*d*) is a side view, and FIG. 8(*e*) is a vertical cross-sectional view of FIG. 8(*d*).

The eraser for thermochromic ink use 12 is formed in an annular shape and has a groove part 27 which is formed recessed at its outer circumference. The eraser for pencil lead use 11 is fit over the entire circumference of this. The eraser for thermochromic ink use 12 and the eraser for pencil lead use 11 are joined by a binder, mated, integrally formed by two-color molding, etc. The eraser for pencil lead use 11 is formed with curved surface parts 28*a*, 28*b*, 28*c*, and 28*d* which have different curvatures when viewed from the front. By the different curved surface parts having different curvatures, it is possible to freely select the erased area and erased width.

Further, by forming this into a ring shape with a through hole 22, the eraser can be inserted over the finger of the user or the shaft of a writing instrument etc. For example, when an eraser is formed at the back end part of a writing instrument, at the time of erasure, since the erasing part is at the opposite side to the writing side, an inversion operation becomes necessary, so the erasure operation ends up taking time, but by fitting the eraser over the finger, it is possible to fit it on a different hand from the writing instrument and quickly switch it with the writing instrument, so erasure becomes possible with no delay in time. Further, it is possible to insert it over a writing instrument or another substantially circular cross-section shaft so as to prevent a writing instrument with no clip from rolling about when placed on a desktop etc. In this case, the eraser for thermochromic ink use 12 may be a material which has rubbery elasticity, but it is inserted over the finger, so to obtain a comfortable fit, it is preferably made a soft plastic or semihard plastic with no surface stickiness. Further, the eraser for thermochromic ink use 12 may be formed by a material similar to the eraser for pencil lead use 11.

Figure 9:
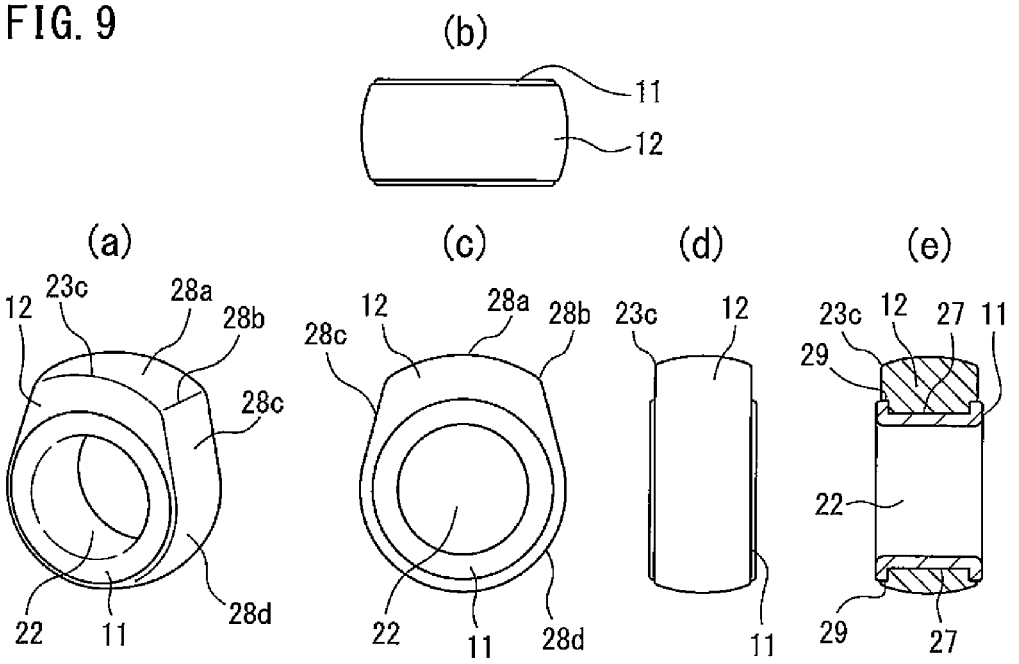
FIG. 9 is an overall view of a seventh example of an eraser in the present invention.

FIG. 9 is an overview of a seventh example of a ring-shaped eraser. FIG. 9(*a*) is a perspective view from the front, FIG. 9(*b*) is a plan view, FIG. 9(*c*) is a front view, FIG. 9(*d*) is a side view, and FIG. 9(*e*) is a vertical cross-sectional view of FIG. 9(*d*).

The difference from the sixth example of an eraser of FIG. 8 is that the relationship of the eraser for pencil lead use 11 and the eraser for thermochromic ink use 12 is inverted. The eraser for thermochromic ink use 12 is fit over the circumference of the eraser for pencil lead use 11. The eraser for thermochromic ink use 12 is fit over the groove part 27 and the step parts 29 which are formed at the two side surfaces of the outer circumference of the groove part 27, so the contact area with the eraser for pencil lead use 11 is increased and thereby the fastenability can be improved.

Figure 10:
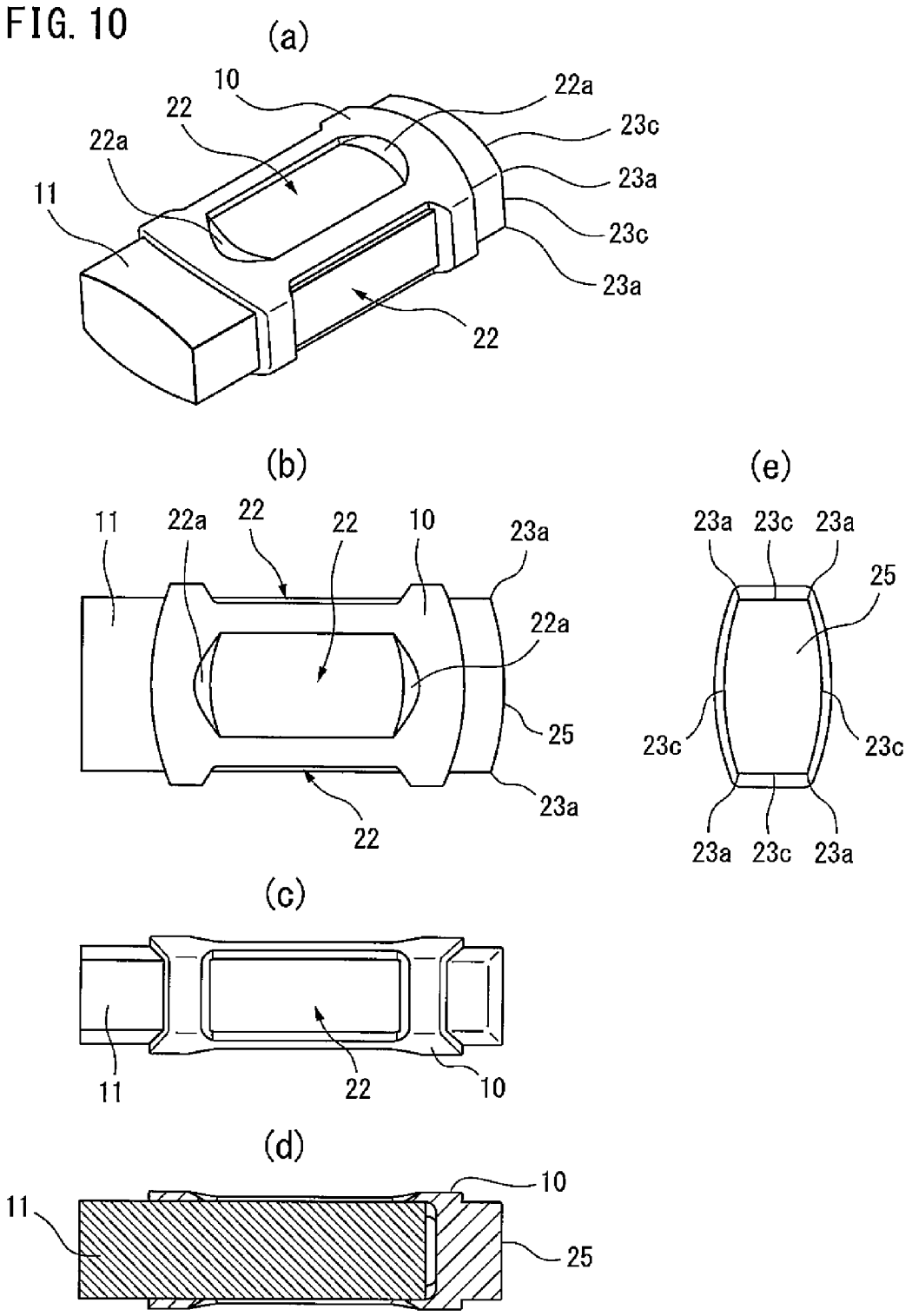
FIG. 10 is an overall view of an eighth example of an eraser in the present invention.
Figure 11:
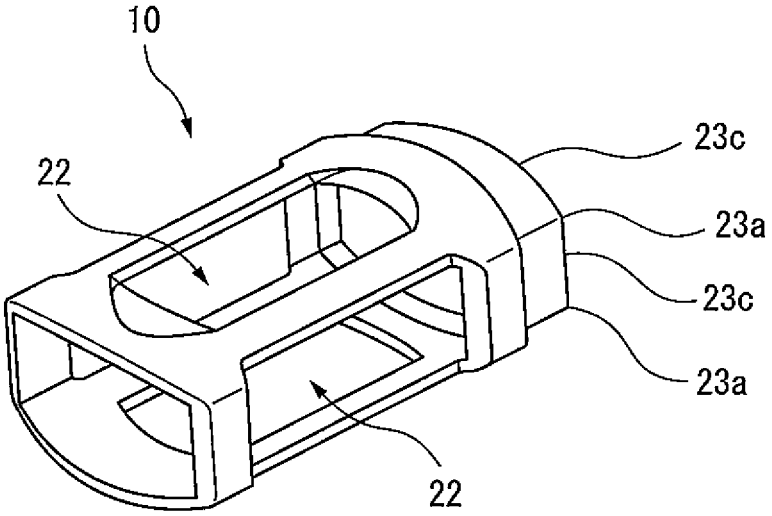
FIG. 11 is a perspective view of a case of the eighth example of an eraser in the present invention.

FIG. 10 is an overview of an eighth example of an eraser where the eraser case is an eraser and show a modification of the third example. FIG. 10(*a*) is a perspective view from the front, FIG. 10(*b*) is a plan view, FIG. 10(*c*) is a front view, FIG. 10(*d*) is a vertical cross-sectional view of FIG. 10(*c*), and FIG. 10(*e*) is a side view. Further, the FIG. 11 is a perspective view of the eraser case of the eighth example.

In the third example of the eraser, the eraser for thermochromic ink use 10 was formed in a closed bottom box shape. The bottom surface was provided with a through hole 22, while the side surfaces were provided with recessed parts 24. As opposed to this, the eraser case constituted by the eraser for thermochromic ink use 10 of the eighth example of an eraser is provided with a plurality of through holes 22 at the side surfaces, for example, at positions corresponding to the recessed parts 24 of the third example. Furthermore, the end edges of the eraser for thermochromic ink use 10 defining the through holes 22 are cut, partially or over the entire circumferences, at an angle to form slanted surface parts 22*a*. The bottom surface of the eraser for thermochromic ink use 10 may be provided with the through hole 22 or not provided with it.

By the side surfaces of the eraser for thermochromic ink use 10 being provided with the through holes 22, it becomes easy to take out the eraser for pencil lead use 11 from the eraser for thermochromic ink use 10. That is, the area of the abutting surfaces of the eraser for thermochromic ink use 10 and the eraser for pencil lead use 11 becomes smaller, so the frictional resistance between the two erasers when taking out one becomes smaller.

Further, at the time of the erasure operation, the two erasers can be directly and simultaneously gripped by the fingers, so marks etc. can be erased without slipping. That is, the eighth example of an eraser has the outer surface of the eraser for pencil lead use 11 exposed through the through holes 22 of the eraser for thermochromic ink use 10. Therefore, if trying to grip the eraser for the erasure operation, parts of the fingers hold the eraser for pencil lead use 11 through the through holes 22 while the other parts of the fingers hold the eraser for thermochromic ink use 10 around the through holes 22. In other words, the through holes 22 are determined in positions and shapes so as to enable the two erasers to be directly and simultaneously gripped by the fingers. Furthermore, by the end edges of the eraser for thermochromic ink use 10 which define the through holes 22 being formed with the slanted surface parts 22*a*, since those parts are formed thinner compared with other parts, they easily elastically deform. For this reason, by gripping these parts by the fingers, it becomes possible to more reliably directly and simultaneously grip the two erasers by the fingers.

As another feature, the eraser for thermochromic ink use 10, in the same way as the above embodiments, has corner parts 23*a* and line parts 23*c* which enable minute areas to be erased by light force and a curved surface part 25 which enables the erased area to be freely and easily selected by the user.

According to the above-mentioned embodiment of the present invention, the first erasing member constituted by the eraser for thermochromic ink use can be used as a container for the second erasing member constituted by the eraser for pencil lead use and thereby the first erasing member can be made integral with the second erasing member, so it is possible to provide an eraser which is able to erase marks without regard as to the type of ink or lead of the writing instrument. Further, by making the first erasing member a closed bottom shape and covering the outer surface of the second erasing member, it is possible to facilitate the positioning of the second erasing member and easily grip it by the fingers.

Further, the first erasing member has a higher Durometer A hardness or Durometer D hardness than the second erasing member so when the second erasing member is placed inside the first erasing member, it can be placed there without causing unnecessary deformation.

Figure 12:
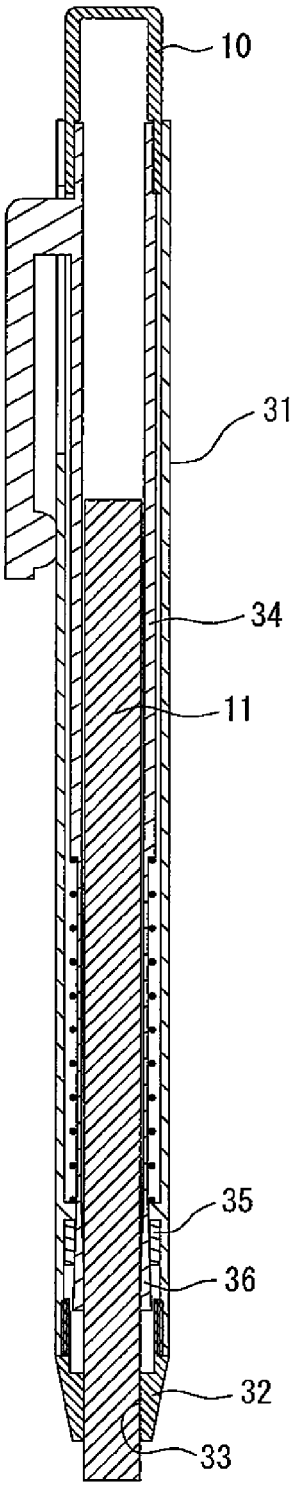
FIG. 12 is a vertical cross-sectional view of a first example of a writing instrument which is provided with an eraser in the present invention.

FIG. 12 shows a first example of a plunger type writing instrument of the present invention. In the present embodiment, the first erasing member constituted by the eraser for thermochromic ink use 10 is a single plunger type eraser formed integrally with a plunger cover as illustrated, while the second erasing member constituted by the eraser for pencil lead use 11 is housed inside the tube 31. By making this a single tubular eraser of the same form as a general writing instrument, the width is not large, so there are the advantages that it is easy to store it in a writing instrument case etc. and is excellent in portability. Note that, in this Description, the side from which the writing part sticks out is defined as the "front" side and the side opposite to the writing part is defined as the "back" side.

Here, "thermochromic ink" means ink which has the property of maintaining a predetermined color (first color) at ordinary temperature (for example 25° C.), changing to a separate color (second color) when made to rise to a predetermined temperature (for example 60° C.) then returning again to the original color (first color) when cooled down to a predetermined temperature (for example −5° C.). In thermochromic ink, making the above second color an invisible color and raising the temperature of the lines written by the first color (for example red) to make them colorless is referred to here as "erasing". Therefore, in the following embodiment, paper etc. on which lines are drawn is rubbed against by a rubbing member constituted by the eraser for thermochromic ink use to generate heat of friction and thereby make the lines an invisible color, that is, erase them. Note that, only naturally, the second color may also be a visible color rather than an invisible color. Further, the thermochromic ink may also be made a non-reversible one such as described in Japanese Patent Publication No. 2010-241867A.

Further, the media which are used to make the lines which are erased by the second erasing member in the present invention include not only pencil lead, but also lead of mechanical pencils and ink which can be erased by rubbing but not thermochromic ink. For example, "erasable ink" indicates ink in which water, nonthermoplastic colored resin particles, and the noncolored particles are at least contained.

The operation for feeding out the front end part of the eraser for pencil lead use 11 from the tube 31 is as follows: The back end of the eraser for thermochromic ink use 10 is pushed to make it advance inward. Linked with this, the chuck member 34 and the fastener 35 integrally advance. Next, the front end of the fastener 35 strikes the back end of the nozzle 32 whereby further advance is stopped. The chuck member 34 alone is made to further advance to make the taper part 36 at the front end open. As a result, the eraser for pencil lead use 11 is inserted through the front end hole of the chuck member 34 by its own weight, so the front end of the eraser for pencil lead use 11 abuts against the back end of the inside diameter part 33 of the nozzle 32. By repeating this clicking operation, the eraser for pencil lead use 11 is successively projected out from the front end of the inside diameter part 33 of the nozzle 32. This mechanism is the same as that of a usually known plunger type mechanical pencil, so further explanation will be omitted.

Further, at the front end of the tube 31, the nozzle 32 is fastened by screwing it to the tube. Further, at the inside diameter part 33 of the nozzle 32, a part for engaging by friction with the outer surface of the eraser for pencil lead use 11 and suitably holding the eraser for pencil lead use 11 is provided by projections or ribs etc. Note that, by forming the nozzle 32 by the later explained material of the eraser for thermochromic ink use, use as the eraser for thermochromic ink use is also possible. Due to this, the eraser for pencil lead use and the eraser for thermochromic ink use can be easily switched.

Figure 13:
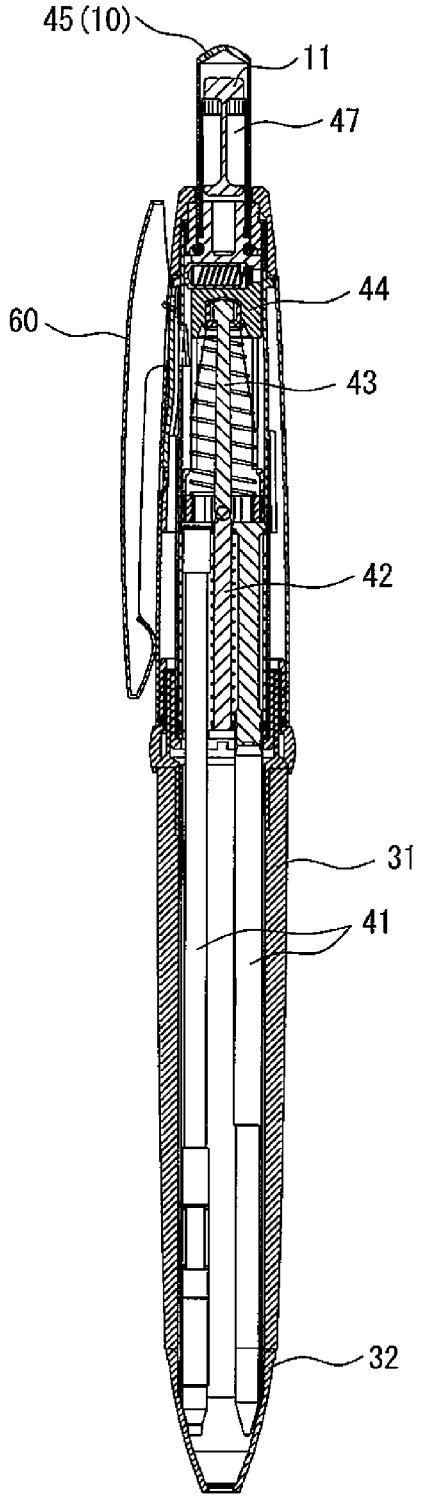
FIG. 13 is a vertical cross-sectional view of a second example of a writing instrument which is provided with an eraser in the present invention.

FIG. 13 is a combination writing instrument constituting a second example of a writing instrument which is provided with an eraser of the present invention. The combination writing instrument which is shown in FIG. 13 is designed to allow a refill 41 to be exposed from the front end of the tube 31 and enable writing by pressing forward the back end plunger cover 45. By pressing the back end part of the clip 60 to the axial center, the refill 41 is retracted into the tube 31. Specifically, this combination writing instrument has a plurality of refills 41 inside the tube 31, a guide tube 42 which is arranged inside the tube 31 and separates the refills 41, a pendulum rod 43 which is formed in a rod shape which extends in a longitudinal direction of the combination writing instrument and which is arranged at the back of the refills, a slide piece 44 which is attached to the back end part of the pendulum rod 43, and a plunger cover 45. Further, the desired refill 41 for obtaining the marks is selected by the pendulum rod 43 which is driven by gravity. That is, the user tilts the tube 31 from the vertical direction corresponding to the position of the desired refill 41 to position it at a corresponding section of the guide tube 42 to thereby make the pendulum rod 43 tilt by gravity and make the front end of the pendulum rod 43 face the back end of the desired refill 4. Next, the user pushes down the plunger cover 45 to make the positioned pendulum rod 43 advance and push against the desired refill 41 so that the front end of the refill 41 is made to stick out from the front end of the tube 31. This combination writing instrument enables a refill to be projected out or retracted by a single hand and further, compared with a combination writing instrument which has operating parts which stick out from the tube, it is possible to give the writing instrument an excellent clean tubular design.

The plurality of refills 41 which are contained in the tube 31 of the combination writing instrument include at least one mechanical pencil refill and ball pen refill. The mechanical pencil refill contains pencil lead, while the ball pen refill is filled with thermochromic ink. Alternatively, the mechanical pencil refill holds a thermochromic lead which has properties similar to those of thermochromic ink, while the ball pen refill may be filled with an erasable ink. Alternatively, it is possible to add a mechanical pencil refill 41 inside the tube 31 and use the core as an eraser for pencil lead use or an eraser for thermochromic ink use. Furthermore, the refill 41 may also be a felt pen refill, brush refill, etc.

Figure 14:
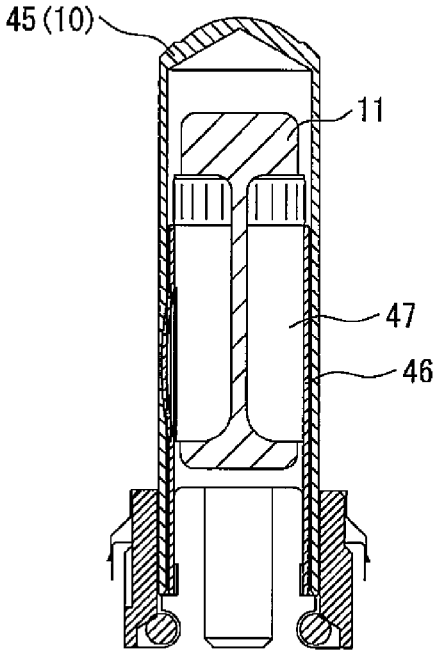
FIG. 14 is an enlarged vertical cross-sectional view of a back part of the second example of a writing instrument which is provided with an eraser in the present invention.

FIG. 14 is an enlarged vertical cross-sectional view of a back part of a second example of a writing instrument which is provided with an eraser in the present invention. The plunger cover 45 of the back end of the combination writing instrument can be used as the first erasing member constituted by the eraser for thermochromic ink use 10. Further, inside the plunger cover 45, the tube shape erasing member holder 47 is fit detachably with respect to the tube shape plunger pipe 46 which is provided at the back end part of the tube 31. The erasing member holder 47 is formed in a columnar state and holds the second erasing member constituted by the eraser for pencil lead use 11. Therefore, the eraser for pencil lead use 11 can be attached to and detached from the plunger pipe 46, that is, the tube 31, through the erasing member holder 47. For this reason, the eraser for pencil lead use 11 will not scratch the side surfaces when attached to or detached from the plunger pipe 46.

Figure 15:
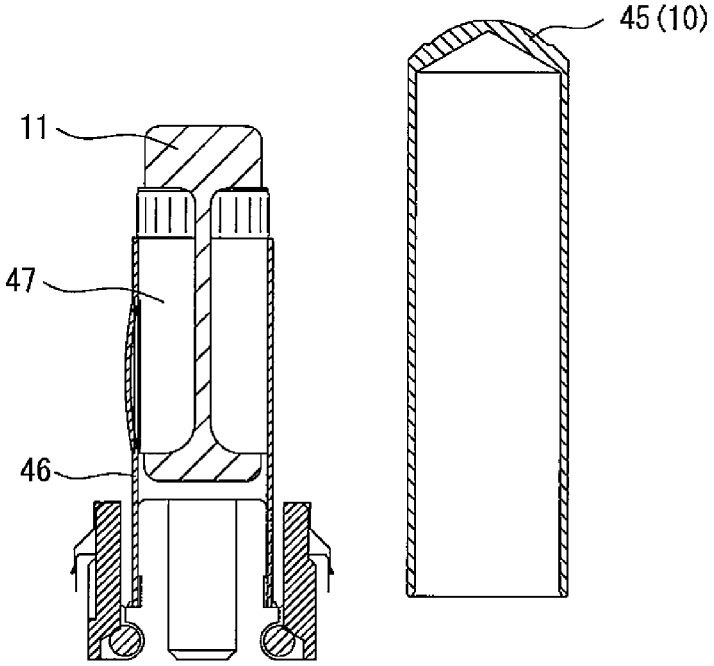
FIG. 15 is an enlarged vertical cross-sectional view of a back part which shows a state of use of the second example of a writing instrument which is provided with an eraser in the present invention.

FIG. 15 is an enlarged vertical cross-sectional view of the back part which shows the state of use of the second example of a writing instrument which is provided with an eraser in the present invention. When erasing marks made by thermochromic ink, the eraser for thermochromic ink use 10 constituted by the plunger cover 45 is used to rub against the marks to generate heat of friction and erase them. At this time, the plunger cover 45 may be used in a state attached to the back end part of the tube 31 or may be used in a state detached from the tube 31 and separate.

On the other hand, when erasing marks made by pencil lead, the plunger cover 45 is detached and the eraser for pencil lead use 11 is used to rub against the marks to erase them. At this time, the eraser for pencil lead use 11 may be used in the state attached to the back end part of the tube 31 or may be used in a state detached from the tube 31 together with the erasing member holder 47.

Note that, in the present embodiment, by forming the eraser which is held at the erasing member holder 47 by the material of the eraser for thermochromic ink use 10, it is possible to use it as an eraser for thermochromic ink use and by forming the plunger cover 45 by the material of the eraser for pencil lead use 11, it is possible to use it as an eraser for pencil lead use.

Figure 16:
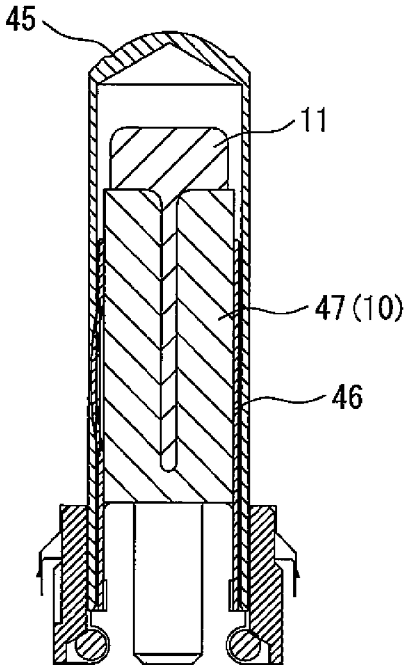
FIG. 16 is an enlarged vertical cross-sectional view of a third example of a writing instrument which is provided with an eraser in the present invention.

FIG. 16 is an enlarged vertical cross-sectional view of a back part of a third example of a writing instrument which is provided with an eraser in the present invention. The point of difference from the second example of a writing instrument which is provided with an eraser is the fact that the plunger cover 45 is a simple cover member which prevents the eraser from becoming dirty and which is not used as an eraser. Instead, the erasing member holder 47 is formed by the material of the first erasing member constituted by the eraser for thermochromic ink use 10 so as to use it as the eraser for thermochromic ink use 10.

Figure 17:
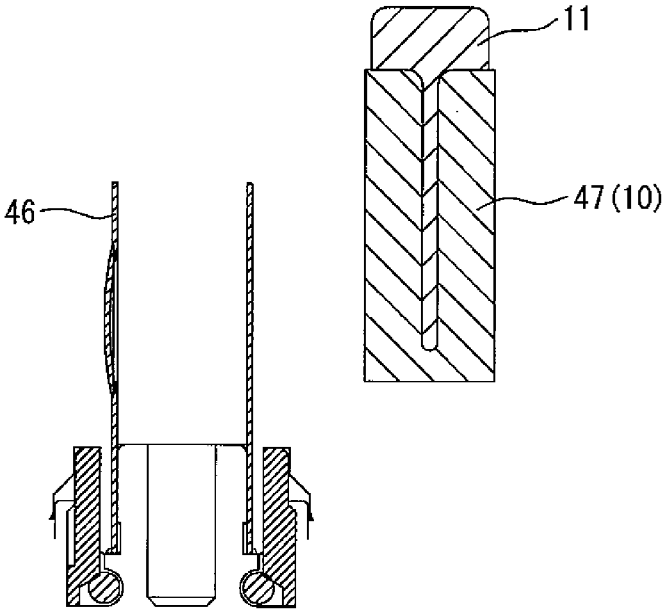
FIG. 17 is an enlarged vertical cross-sectional view of a back part which shows a state of use of the third example of a writing instrument which is provided with an eraser in the present invention.

FIG. 17 is an enlarged vertical cross-sectional view of a back part which the state of use of the third example of a writing instrument which is provided with an eraser in the present invention. When erasing marks made by thermochromic ink, the eraser for thermochromic ink use 10 constituted by the erasing member holder 47 is detached from the plunger pipe 46, then the erasing member holder 47 is used to rub against the marks to cause the heat of friction and erase them.

On the other hand, when erasing marks made by pencil lead, the eraser for pencil lead use 11 is detached from the plunger pipe 46 together with the erasing member holder 47, then the eraser for pencil lead use 11 is used to rub against the marks to erase them. At this time, the eraser for pencil lead use 11 may be used in the state attached to the erasing member holder 47 or may be used in the independent state detached from the erasing member holder 47.

Note that, in the present embodiment, by forming the eraser which is held at the erasing member holder 47 by the material of the eraser for thermochromic ink use 10, it is possible to use it as an eraser for thermochromic ink use and by forming the erasing member holder 47 by the material of the eraser for pencil lead use 11, it is possible to use it as an eraser for pencil lead use.

Figure 18:
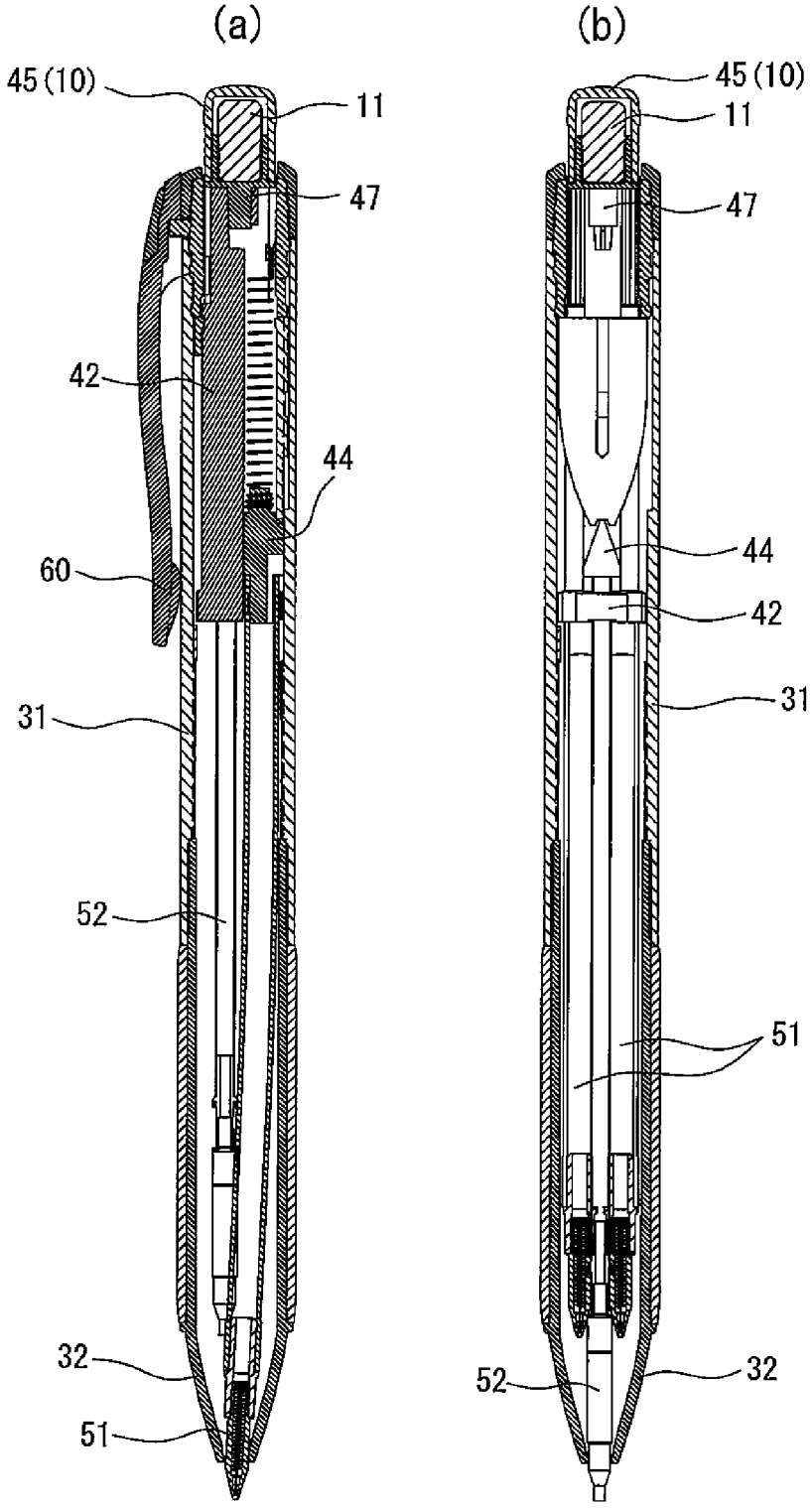
FIG. 18 is a vertical cross-sectional view of a fourth example of a writing instrument which is provided with an eraser in the present invention.

FIG. 18 is a vertical cross-sectional view of a fourth example of a writing instrument which is provided with an eraser in the present invention. FIG. 18(*a*) shows the state where a ball pen etc. refill 51 is made to stick out, while FIG. 18(*b*) shows the state where a mechanical pencil refill 52 is made to stick out. At the back end of the combination writing instrument, a plunger cover 45 which can be used as the first erasing member constituted by the eraser for thermochromic ink use 10 is attached. Inside the plunger cover 45, the erasing member holder 47 is fastened to the back end part of the tube 31. The erasing member holder 47 holds the second erasing member constituted by the eraser for pencil lead use 11. Therefore, the eraser for pencil lead use 11 is formed in a columnar shape and can be attached to and detached from the erasing member holder 47.

The tube 31 contains ball pen etc. refills 51 in which thermochromic property thermochromic ink or erasable ink is filled and a mechanical pencil refill 52 in which pencil lead or thermochromic lead is contained. By giving a single writing instrument two or more types of refills and two types of erasers in an integral package, storage in a writing instrument case etc. becomes easy and a superior portability writing instrument and eraser can be realized. Note that, the writing part at the ball pen etc. refill may be a ball, felt tip, brush, etc. in the case of liquid ink.

As the operation for selection of a refill, if turning the clip 60 about the tube 31, along with rotation of the cylindrical cam 53, due to the cam swash 54, some sort of refill is selected and the tip can be made to stick out from the front end opening of the nozzle 32. Further, when the selected refill is a mechanical pencil refill 52, the back end of the eraser for thermochromic ink use 10 is clicked to feed out the lead.

When erasing marks made by pencil lead etc., the plunger cover 45 constituted by the eraser for thermochromic ink use 10 is detached and the eraser for pencil lead use 11 is used. Further, the eraser for thermochromic ink use 10 can be used in a state attached to the writing instrument or a separate state detached from it.

Figure 19:
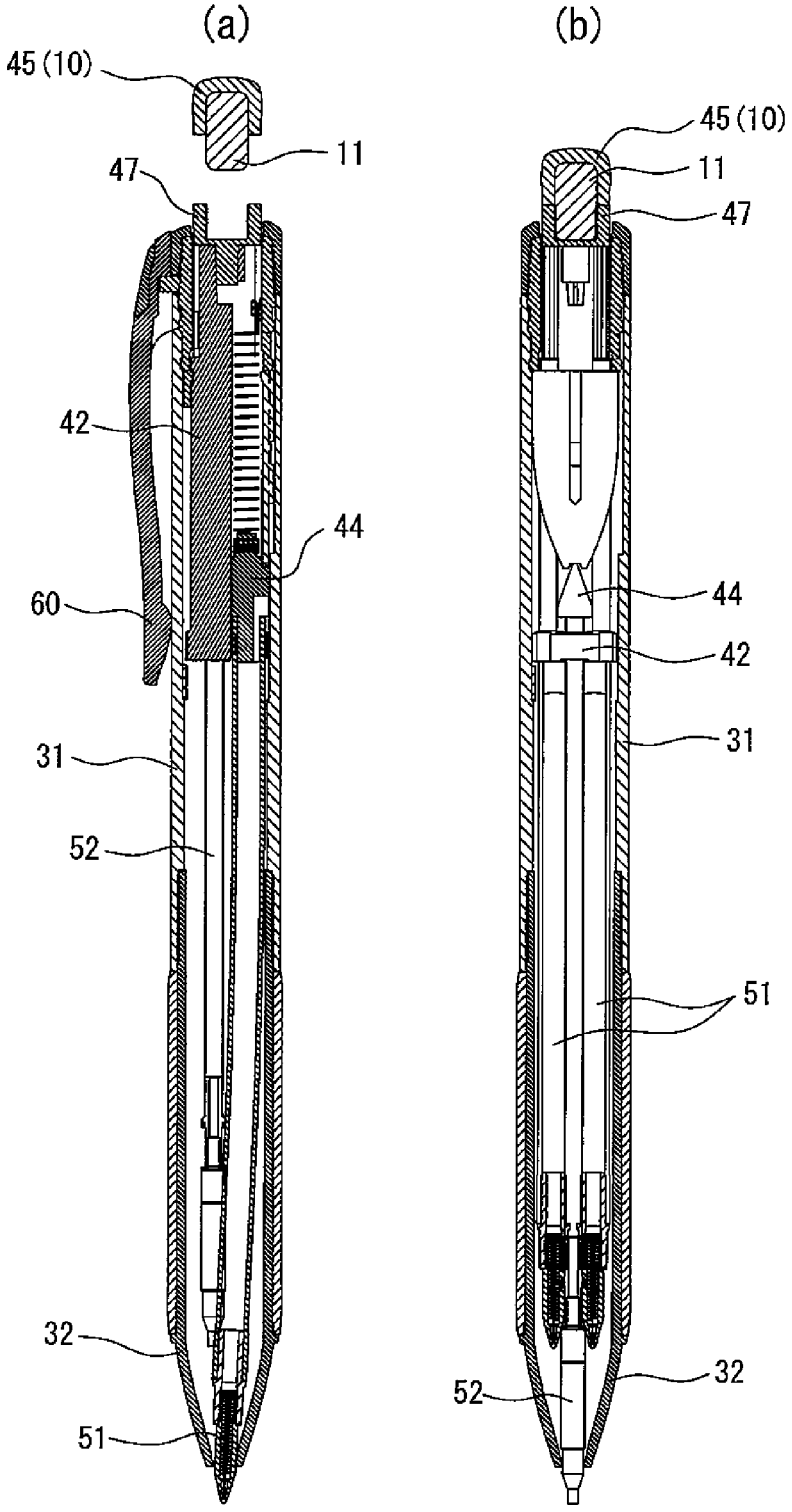
FIG. 19 is a vertical cross-sectional view of a fifth example of a writing instrument which is provided with an eraser in the present invention.

FIG. 19 is a vertical cross-sectional view of a fifth example of a writing instrument which is provided with an eraser in the present invention. FIG. 19(*a*) shows the state where a ball pen etc. refill 51 is made to stick out, while FIG. 19(*b*) shows the state where the mechanical pencil refill 52 is made to stick out. The point of difference from the fourth example is that the plunger cover 45 constituted by the eraser for thermochromic ink use 10 and eraser for pencil lead use 11 are integrally formed by two-color molding or adhesion etc. and can be attached to and detached from the erasing member holder 47. Note that in the erasing member holder 47, the inside surfaces which engage with the eraser for pencil lead use 11 are formed with a plurality of ribs in the axial direction so that even if the back end side of the writing instrument is made to face vertically downward, the eraser for pencil lead use 11 will not drop off.

Note that, in the fourth example and fifth example, by forming the eraser which is held at the erasing member holder 47 by the material of the eraser for thermochromic ink use 10, the eraser may also be utilized as an eraser for thermochromic ink use, while by forming the plunger cover 45 by the material of the eraser for pencil lead use 11, it may also be utilized as an eraser for pencil lead use.

According to the above-mentioned embodiments of the present invention, there is provided an eraser for erasing lines written by a writing instrument characterized by being provided with a first erasing member for erasing marks made by a liquid ink and a second erasing member for erasing marks made by a solid which are joined integrally. Due to this, it is possible to provide a writing instrument which is provided with an eraser which is able to erase marks regardless of the type of the ink or lead of the writing instrument.

Further, the first erasing member and the second erasing member have Durometer A hardnesses or Durometer D hardnesses, prescribed by JIS K6253, which are different from each other, so at the time of erasure, the first erasing member and the second erasing member can be easily differentiated and simply selectively used.

Further, the eraser for thermochromic ink use is selected from a material which has rubbery elasticity, a soft plastic, or a semihard plastic. It is preferably comprised of one or more materials among various types of thermoplastic resins, heat curing materials, thermoplastic materials, sintered inorganic matter or organic matter, etc. (each alone or two types or more mixed). As the thermoplastic material which can be used as the eraser for thermochromic ink use, an olefin based, styrene based, urethane based, polyester-based, fluorine based, or other thermoplastic elastomer can be used. Further, as the heat curing material, for example, a silicone based, epoxy based, urethane based, melamine based, urea based, phenol based, or other various types of synthetic rubber or natural rubber can be used. Furthermore, a material which is comprised of a mixture of a polypropylene resin and styrene-based thermoplastic elastomer or a mixture of a polypropylene resin and polypropylene-based thermoplastic elastomer and has a mixing ratio of respectively a weight ratio of 1:1 to 1:4, more preferably a material which is comprised of a mixture of an olefin-based resin and olefin-based thermoplastic elastomer and has a mixing ratio of a weight ratio of 1:2.5 to 1:3.5 is particularly preferable since at the time of erasing a mark, the heat of friction can be easily generated and self wear becomes small.

Further, the eraser for pencil lead use is selected from ones which are used as erasers based on the quality standards described in JIS 56050 such as an PVC eraser comprised of a PVC resin, non-PVC eraser comprised of a styrene-based thermoplastic elastomer or olefin-based thermoplastic elastomer, and eraser comprised of natural rubber etc.

Note that, the eraser of the present invention is not particularly limited in shape etc. For example, it may be made a columnar shape, rectangular prism shape, triangular prism shape, block shape, or a complicated shape which has relief shapes or projections on its surface, but shapes which integrally form corner parts which enable contact in a point manner and end parts which enable contact in a planar manner are preferable.

Further, the first erasing member and the second erasing member of the present invention may, to an extent not detracting from the effects of the present invention, have a coloring agent, fragrance, etc. mixed into their materials to improve the fanciness and distinctiveness and may further have a thermochromic material mixed into them to enable them to change in color due to heat of friction when erasing marks.

INDUSTRIAL APPLICABILITY

As explained above, the present invention provides an eraser which is able to effectively erase marks by a pencil or other writing instrument which uses solid lead or a marks by a writing instrument which uses thermochromic ink and a writing instrument which is provided with such an eraser. It is a useful invention which can be utilized in industry. The present invention will be explained in detail based on specific embodiments, but a person skilled in the art could make various changes, modifications, etc. without departing from the claims and concept of the present invention.

REFERENCE SIGNS LIST

10 eraser for thermochromic ink use (first erasing member)
11 eraser for pencil lead use (the second erasing member)
12 eraser for thermochromic ink use
13 eraser
14*a* front part
14*b* back part
21 cut
22 through hole
23*a* corner part
23*b* end part
23*c* line part
24 recessed part
25*a* corner part
25 curved surface part
26 flat part
27 groove part
28*a* curved surface part
28*b* curved surface part
28*c* curved surface part
28*d* curved surface part
29 step part
31 tube
32 nozzle

33 inside diameter part
34 chuck member
35 fastener
36 taper part
41 refill
42 guide tube
43 pendulum rod
44 slide piece
45 plunger cover
46 plunger pipe
47 erasing member holder
51 ball pen etc. refill
52 mechanical pencil refill
53 cylindrical cam
54 cam swash

The invention claimed is:

1. An eraser comprising an erasing member and a closed bottom case configured to hold inside the erasing member, wherein the erasing member is a thermochromic ink eraser, wherein the case comprises side surfaces and a bottom surface, which is perpendicular to the side surfaces, and wherein the side surfaces include through holes such that the erasing member and the case can be simultaneously gripped through the through holes at the time of an erasure operation.

2. The eraser of claim 1, wherein the bottom surface contains a through hole.

* * * * *